US010214398B2

(12) United States Patent
Lishanski et al.

(10) Patent No.: US 10,214,398 B2
(45) Date of Patent: Feb. 26, 2019

(54) LISHANSKI VIBRATING TRANSPORT DEVICE AND ASSOCIATED METHOD FOR MOVEMENT OF OBJECTS ON VERTICAL, HORIZONTAL AND INCLINED BASIC SURFACES

(71) Applicants: Grigori Lishanski, Mequon, WI (US); Oleg Lishanski, Buffalo Grove, IL (US)

(72) Inventors: Grigori Lishanski, Mequon, WI (US); Oleg Lishanski, Buffalo Grove, IL (US)

( * ) Notice: Subject to any disclaimer, the term of this patent is extended or adjusted under 35 U.S.C. 154(b) by 0 days.

(21) Appl. No.: 15/392,260

(22) Filed: Dec. 28, 2016

(65) Prior Publication Data

US 2018/0179034 A1 Jun. 28, 2018

(51) Int. Cl.

| | |
|---|---|
| ***B66F 3/00*** | (2006.01) |
| ***B66F 19/00*** | (2006.01) |
| ***B66F 13/00*** | (2006.01) |

(52) U.S. Cl.

CPC ..... *B66F 3/00* (2013.01); *B66F 13/00* (2013.01); *B66F 19/00* (2013.01); *B66F 2700/09* (2013.01)

(58) Field of Classification Search

CPC .. B66F 3/00; B66F 13/00; B66F 19/00; B66F 2700/09; F03G 3/00

USPC ..... 414/800

See application file for complete search history.

(56) References Cited

U.S. PATENT DOCUMENTS

| | | | | |
|---|---|---|---|---|
| 3,916,704 | A * | 11/1975 | Gaberson | F03G 3/00 180/54.1 |
| 6,109,123 | A * | 8/2000 | Baskis | F03G 3/00 74/572.1 |
| 2006/0169073 | A1* | 8/2006 | Charette | F03G 3/00 74/84 S |
| 2014/0284938 | A1* | 9/2014 | Xu | F03G 1/00 290/1 R |
| 2014/0299415 | A1* | 10/2014 | Barbiero | F03G 1/00 185/2 |
| 2015/0086320 | A1* | 3/2015 | Camp | B66F 1/00 414/800 |

FOREIGN PATENT DOCUMENTS

| | | |
|---|---|---|
| RU | 2042558 | 8/1995 |
| RU | 2042559 | 8/1995 |

* cited by examiner

*Primary Examiner* — Lynn E Schwenning

(74) *Attorney, Agent, or Firm* — Boyle Fredrickson, S.C.

(57) ABSTRACT

A device and method for moving cargo on inclined, horizontal or vertical surfaces utilizes frictional forces selectively applied through the use of induced mechanical vibrations on a loaded, platform in conjunction with the force of gravity acting on the platform. The platform is vibrated to pivot or shift the platform relative to a support structure, engaging a portion of the platform secured to the platform with the support structure. At the furthest extent of this motion, the platform is pulled against the support structure by gravity, disengaging the portion from the support structure. In turn the pivot point for the device is shifted to the point of engagement between the platform and the support structure, which enables the portion of the platform to move upwardly along the support structure. The alternation of this engagement of the platform with the support structure causes the platform to move along the support structure.

10 Claims, 6 Drawing Sheets

LISHANSKI VIBRATING TRANSPORT DEVICE AND ASSOCIATED METHOD FOR MOVEMENT OF OBJECTS ON VERTICAL, HORIZONTAL AND INCLINED BASIC SURFACES

FIELD OF THE INVENTION

The invention is a vibrating transport device and method for movement of objects on vertical, horizontal and inclined basic surfaces. The invention is related to electromechanical vehicles that are able to move through the bearing surfaces and can be used for lifting and moving cargo in the course of work in confined spaces in hazardous areas and in the science research.

BACKGROUND AND SUMMARY OF THE INVENTION

Known transport devices that can move around freely on oriented surfaces are disclosed in Russian Patent No. NQ2042558 which contains two platforms connected to each other. The first platform is provided with indexing mechanism and is designed as a horizontally mounted thereon cylinders. At the ends of the rods, pneumatic cylinders installed sliding support with lifting and lowering devices. The second vacuum gripper is provided with a platform mounted on the support member and provided with a mechanism for rotation of the platform about a vertical axis.

The disadvantages of this design is its complexity, poor performance, low maneuverability and mobility. This is due to the presence of special gear design, which provides a change of direction, the four pneumatic cylinders. Furthermore, the presence of the electric motor in the turning mechanism weigh down the whole structure.

Another example of a invention in the field of the invention is disclosed in Russian Patent No. NQ2042559. The disclosed device comprises a housing and a stepping movement mechanism which is designed as a bilateral cylinders. These cylinders are arranged perpendicular to each other and connected with each other and the housing, and a sliding bearing. The disadvantages of this device are the complexity of design, large dimensions, weighting device (four air cylinder), a large number of units of the air distribution system, complex design device management system.

To solve the technical problem in the prior art, the invention lies is a design and implementation of a fundamentally new way of lifting and moving a vibrating load platform for an inclined, vertical and horizontal support surface as a result of the interaction of a vibrating platform loaded with a ballast weight with a support structure.

A device for cargo moving on inclined, horizontal and vertical surfaces utilizes frictional forces selectively applied through the use of induced vibrations on a loaded platform in conjunction with the force of gravity acting on the platform. The platform is vibrated in a manner that pivots or shifts the platform relative to a support structure, engaging a portion of the platform secured to the platform with the support structure. When the portion is engaged with the support structure, the vibrations of the platform cause the platform to move upwardly relative to the support member, with the platform portion functioning as a pivot point for the movement. At the furthest extent of this motion, the platform is pulled against the support structure by gravity, disengaging the portion from the support structure. In turn the pivot point for the device is shifted to the point of engagement between the platform and the support structure, which enables the portion of the platform to move upwardly along the support structure. The alternation of the engagement of the platform and portion with the support structure caused by the vibration of the platform in this manner causes the platform to move along the support structure.

BRIEF DESCRIPTION OF THE DRAWINGS

The drawings illustrate the best mode currently contemplated of practicing the invention. In the drawings.

DETAILED DESCRIPTION

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
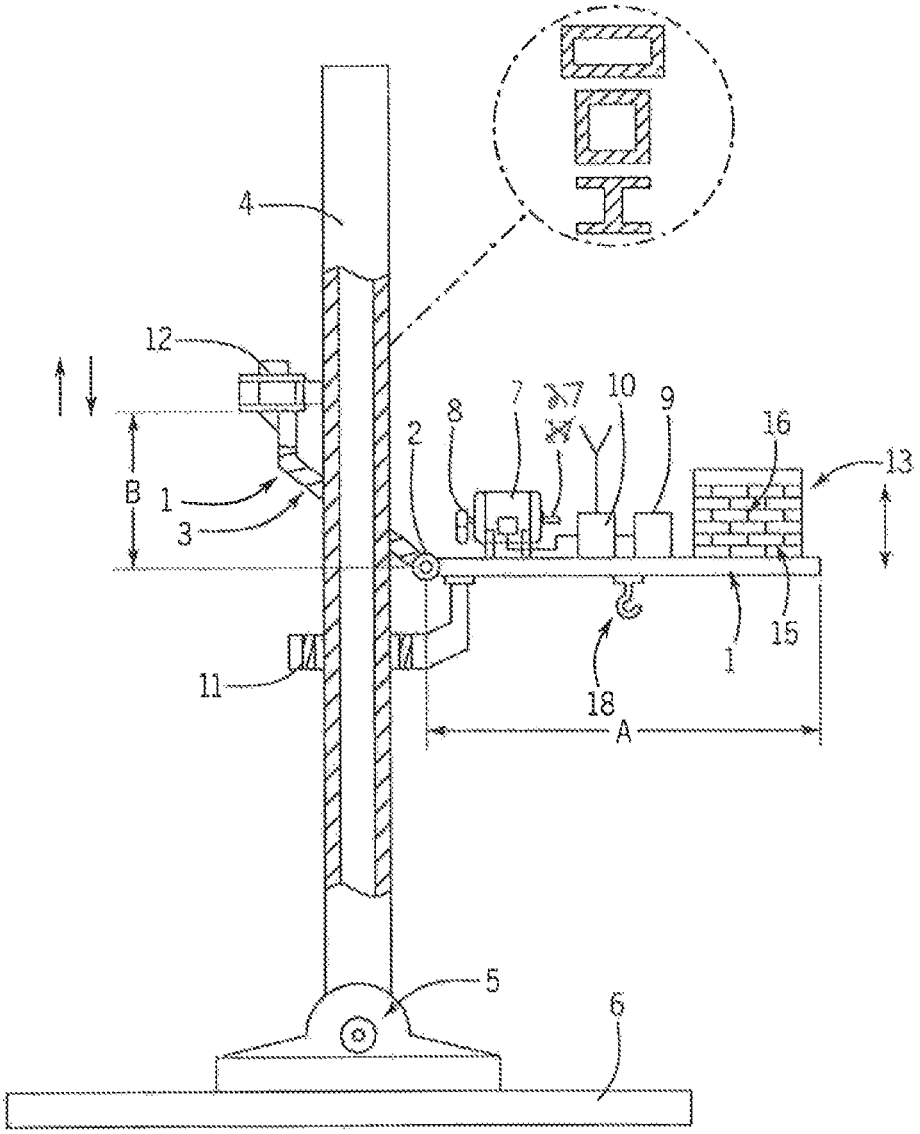
FIG. 1 is a schematic view of a first exemplary embodiment of the invention.

FIG. 1 shows a vibrating platform 1 for moving cargo on vertical mounting surfaces. The platform 1 includes two portions A and B that are interconnected by a pivot mechanism 2. The area of angled portion (B) is less than the area of flat portion (A). The surface of portion (B) of the platform 1 can be set with respect to the portion (A) of the platform 1 at an arbitrary angle of between 0°-135° by setting the pivot mechanism 2 as desired, such that the pivot mechanism 2 can maintain the angle constant during operation of the platform 1. On the platform (B), a through hole 3, whose geometric shape corresponds to the geometric shape of the support structure 4, to define a gap or difference in the perimeter between the hole 3 in portion (B) of the platform 1 and the perimeter of the support structure 4 of approximately 3.5 mm.

The support structure 4 is supported by a rotation mechanism 5 mounted to a base 6 that can be set at to position the support structure 4 at an arbitrary angle of between 0°-90° relative to the base 6.

On the flat portion (A) of the platform 1 is located a motor 7, such as an electric motor. The motor 7 includes an output shaft 27 to which is secured an unbalanced rotor 8. If desired, the opposite end of the shaft 27 of the electric motor 7 can be connected to a second unbalanced rotor (not shown in FIG. 1). The flat portion (A) of the platform 1 also supports a power supply 9, such as a battery, that is connected to the motor 7, an optional remote control unit 10 connected between the power supply 9 and the motor 7 to control the operation of the device, a ballast or weight container 13 for receiving an amount of ballast weight 15, and additionally functioning as a cargo transport 16, and a hook 18 located on the underside of the portion (A) opposite the motor 7. Mode control electric motor 7 and operation all actuators platform 1 is carried out system 10 using the remote control (in FIG. 1 is not shown).

The platform 1 also includes a pair of brakes 11, 12, with brake 11 connected to the portion (A) and extending around the support structure 4, and the brake 12 located on the portion (B) and engaging the support structure 4 opposite the portion (A). The brakes 11, 12 are designed to frictionally engage and hold the platform 1 on the support structure when the motor 7 is not in operation, and to maintain alignment of the platform 1 with the support structure 4 when the motor 7 is being operated.

Before operating the vibrating platform device, it is necessary need to determine the weight for the ballast 15 and to place the ballast 15 within the container 13. The static ballast 15 positioned on the platform 1 is determined to provide a weight that provides an adequate frictional force or gripping mechanism of the platform 1 on the support structure 4, when the platform 1 is frictionally engaged with the support surface 4. In one embodiment, the gripping mechanism is formed by the engagement of the edges of the hole 3 with the surface of the support structure 4, which under the influence of the weight 15 on the platform 1, also including the weight of the motor 7, battery 9, and other cargo and equipment on the portion (A) of the platform 1, creates a zone of direct contact between surfaces of the platform 1 and the support surface 4, or a frictional force that holds the platform 1 in place on the support structure 4.

To operate the device, the motor 7 is activated, such as by utilizing the remote control 10, the motor 7 rotates the shaft 27 and the unbalanced rotor 8. When it the shaft 27 is rotating, vibration is induced in the platform 1 in one exemplary embodiment with a frequency of 10-15 Hz, which corresponds to the number of revolutions of the shaft 27, i.e., 600-900 rev/min. The control 10 can then be utilized to speed up the motor 7 to increase the number of motor revolutions to 1500-3000 rev/min. With the increasing number of revolutions of the rotor shaft 17, the vibration frequency on the platform 1 is increased to 30 Hz to initiate movement of the platform 1 relative to the support structure 4. As the platform 1 is vibrated, the vibrations pivots or shifts the platform 1 relative to the support structure 4 as a result of the gap between the hole 3 and the support structure 4. When the portion (B) is engaged with the support structure 4, the vibrations of the platform 1 cause the portion. (A) of the platform 1 to move upwardly relative to the support structure 4, with the portion (B) functioning as a pivot point for the movement. At the furthest extent of this motion, the platform portion (A) is pulled against the support structure 4 by gravity, disengaging the portion (B) from the support structure 4 and engaging portion (A). In turn, the pivot point for the device is shifted to the point of engagement between the platform portion (A) and the support structure 4, which enables the portion (B) of the platform 1 to move upwardly along the support structure 4. The alternation or rocking motion of the engagement of the platform portion (A) and portion (B) with the support structure 4 caused by the vibration of the platform 1 in this manner causes the platform 1 to move upwardly along the support structure 4. It should be noted that during movement of the platform 1, the vibrations create oscillations in the movement of the platform 1 having an amplitude of about 2.5-3.5mm. With increasing frequency of vibration (with increasing speed) (Rotor 8) is an increase in speed of the vibrating platform 1 upwards on the support surface 4. On reaching the predetermined lifting height, an operator sends a signal to stop the motor 7 and consequent movement of the platform 1.

When the electric motor 7 is turned off, the braking device 11 actively engages the support structure 4 to hold the platform 1 in position, such as to unload cargo 16. In an exemplary embodiment, brake devices 11 and 12 are formed from DC electromagnets, which are easy to fit in a variety of designs of the platform 1 for different operating conditions. In this case the device 11, 12 are used to control the movement of the platform 1 utilizing a variable strength magnetic flux induction selectively created by the braking devices 11, 12 by adjusting the amount of electric current in the passing through the windings (not shown) of said magnets in the brake devices 1, 12 based on the input of the operator via the control signal. The magnetic flux from the electromagnets in the brake devices 11, 12 interact with metal support structure 4, with the magnitude of braking force from the brake devices 11, 12 depending on the current which is directed through the coil of the electromagnet of the respective brake device 11 and/or 12.

To enable the platform 1 to be moved downwardly along the support structure 4, the operator sends a signal to the braking device 12 to selectively engage the support structure 4 to initiate and control the downward movement of the platform 1 as a result of the vibrations from the motor 7, and switches off the brake 11. In an exemplary embodiment, the motor 7 can be operated between 200-3000 revs/min, with a resulting vibration frequency of 10-15 Hz, for movement platform 1. If necessary, increased speed of the downward movement of the platform 1 increases the speed of the motor 7. In addition, depending on the power of the motor 7 (vibrator) of the amplitude and frequency of vibration of the parameter, the load or weight carried by the platform 1 may exceed the total combined weight of the platform 1 and the equipment (motor, 7, battery, 9, etc.) excluding the cargo, by approximately than 2.5-3 times.

Figure 2:
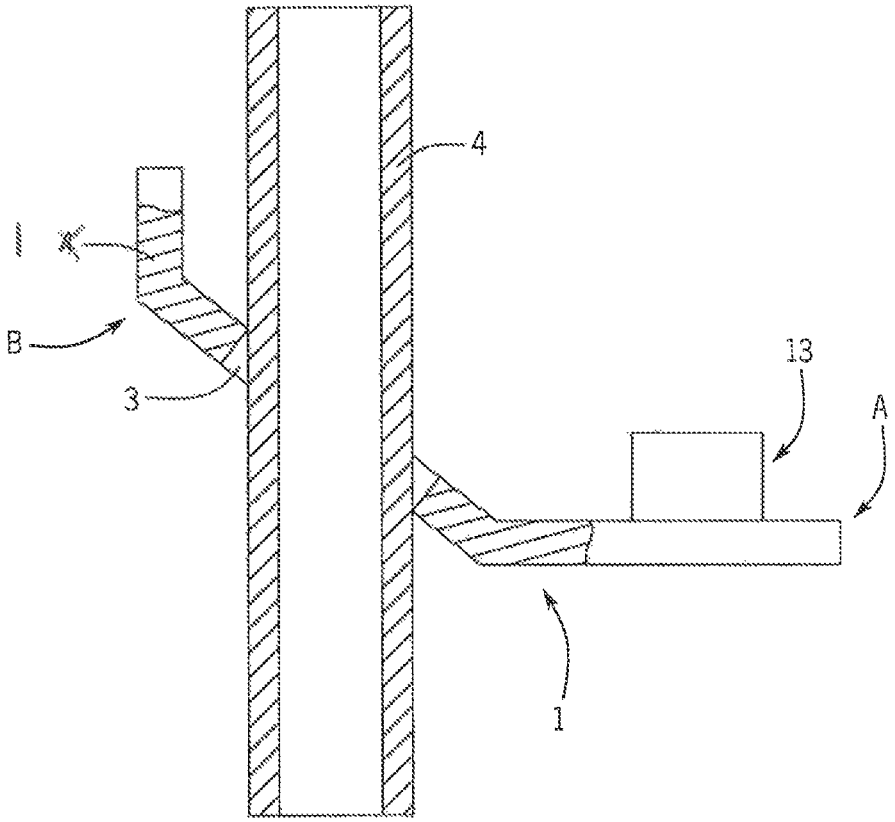
FIG. 2 is a partially broken away schematic view of the embodiment of FIG. 1.

In FIG. 2 an exemplary schematic illustration is shown of different variants of constructions of metal profile (possibly sintered) for manufacturing devices based transport vibrating platform. The inventors have found that for various purposes can be used for construction material and the cylindrical ellipsoid shapes. Therefore, in each case, the profile and the material supporting surface is selected based on the designer technical and technological problems.

Figure 3:
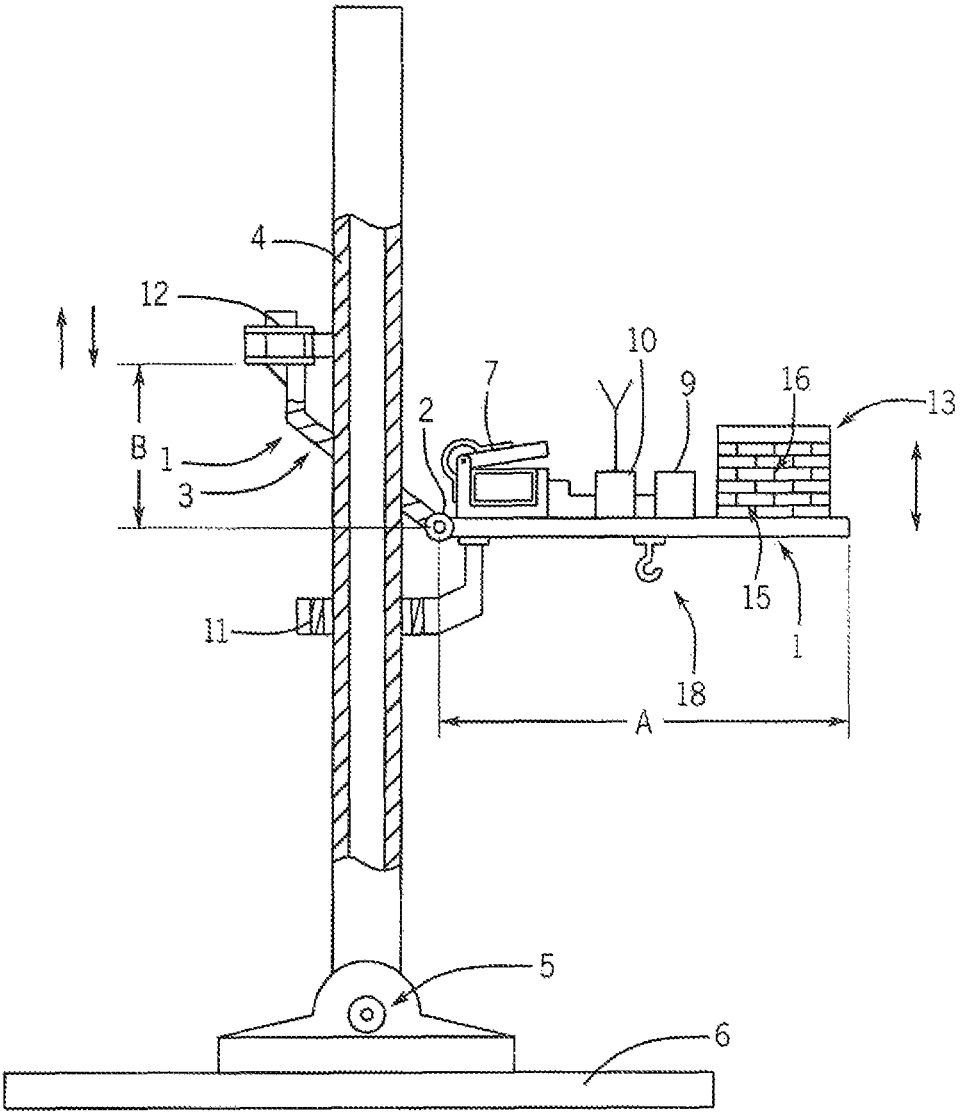
FIG. 3 is a schematic view of a second exemplary embodiment of the invention.

As a result of studies, and a shown in FIG. 3, it was additionally found that the platform 1 can use electromagnetic vibrator 7 in place of the motor 7. In this embodiment, the mechanical vibrations and movement of the platform 1 provided by the vibrator 7 is virtually identical to that using the motor 7. In some cases, depending on the operating conditions of the vibrating platform 1, the use of an electromagnetic vibrator creates additional benefits. For example, an electromagnetic vibrator can feed the cable from the AC current (50-60 Hz) using an adapter that allows you to adjust the frequency of the current pulses. Furthermore, it is possible to adjust the power parameters electromagnet vibrator and its geometrical dimensions of mechanical parts.

Figure 4:
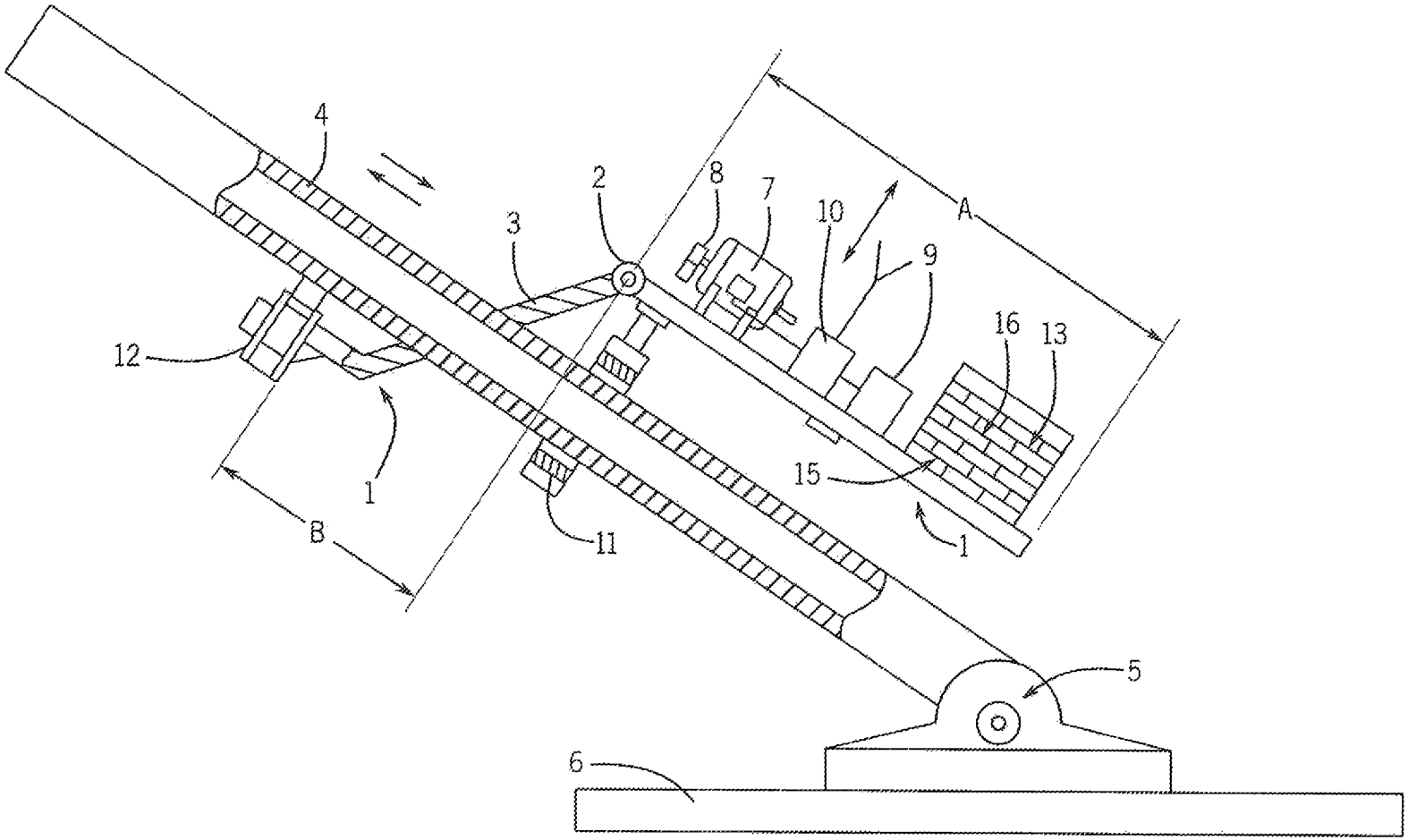
FIG. 4 is a schematic view if a third exemplary embodiment of the invention.

Referring now to FIG. 4, in another exemplary embodiment, a vibrating movement platform 1 is illustrated on an inclined support structure 4. For this purpose the support structure 4 can be set at an arbitrary angle to the base 6 by the rotary mechanism 5. When driving on a sloping vibrating platform reference surface control its operation modes are performed by similar to the motion control mode on the vertical reference surface (see description in FIG. 1). For operation of the vibrating platform 1 on a support structure 4 which is set at an arbitrary angle to the surface 6, the position of the platform portion (A) is parallel to the support surface 4. This can be performed by the operation of the pivot or rotary mechanism 2 to fix the position of the platform portion (A) in this position loduring its movement up or down the support surface 4.

Figure 5:
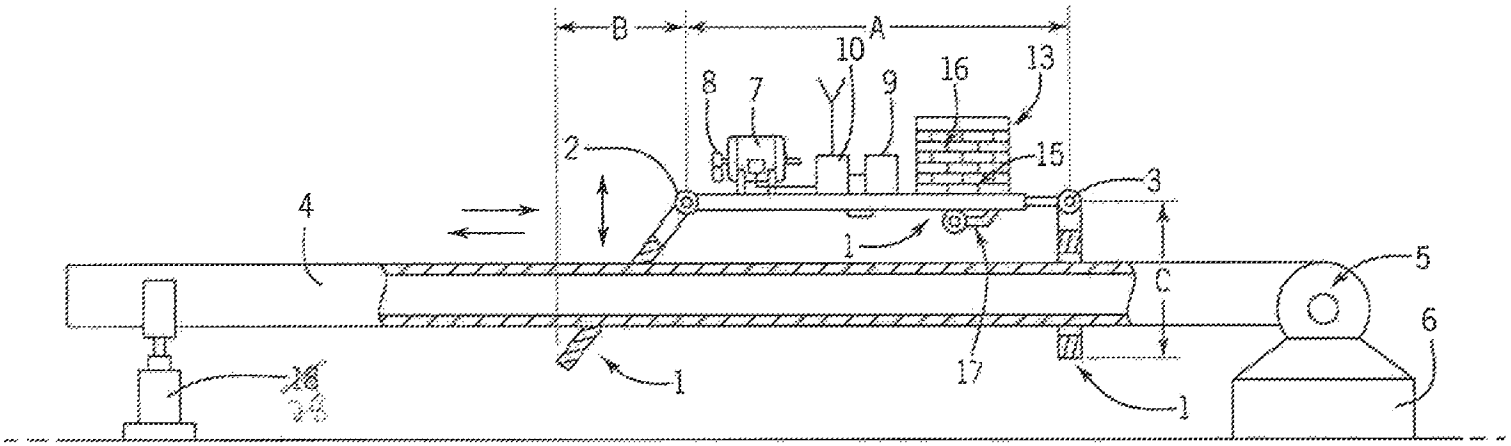
FIG. 5 is a schematic view of a fourth exemplary embodiment of the invention.

In FIG. 5 another exemplary embodiment of the invention is illustrated in which a vibrating movement platform 1 is disposed on a horizontal support surface 4. In this case, the support surface 4 has two support points 6 and 28. Furthermore, on the vibrating platform 1 is mounted: additional pivot of rotary mechanism 2, a secondary support C through which the support structure 4 extends, and a bearing roller 17. In this embodiment, when the device is on a horizontal support structure 4, brake devices 11 and 12 are not used as a stop of the vehicle is performed solely by switching off the electric motor/vibrator 7, and the braking is carried out by friction forces at the points of interaction between the platform portion (B) with the support structure 4.

In the embodiment of FIG. 5, to move the device and platform 1 on the support structure 4, the roller 17 is moved into a vertical position to engage the support structure 4. This enables the roller 17 to support the platform section (A) on the platform during proper installation and engagement of support C and portion (B) in on the support structure 4. Then, the support roller 17 is moved to a stowed position to enable the platform 1 to move along the support structure according to the motion control techniques in the previously mentioned embodiments (FIG. 1-FIG. 3).

Figure 6:
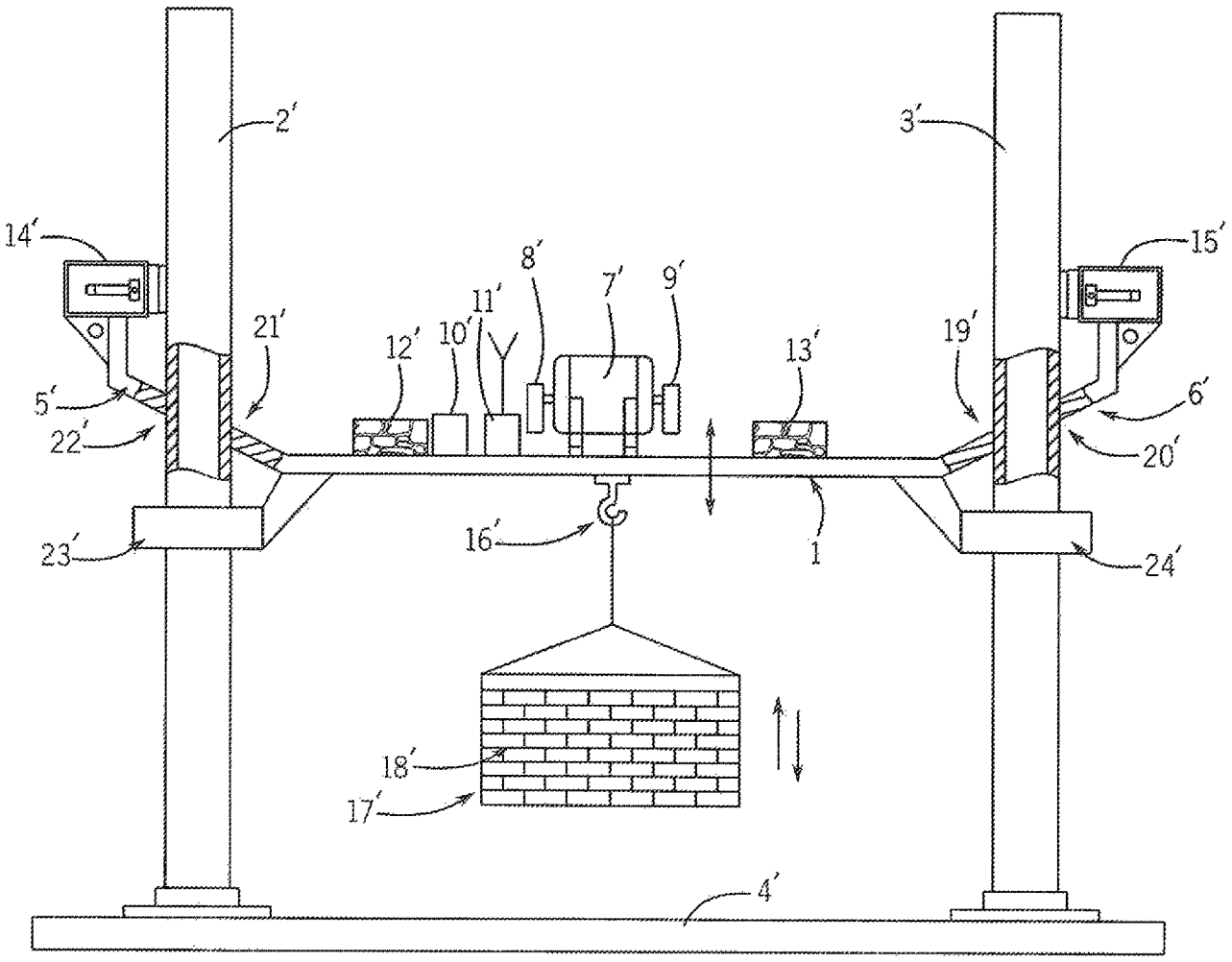
FIG. 6 is a schematic view of a sixth embodiment of the invention.

In FIG. 6 another exemplary embodiment of the invention is illustrated in which a vibrating platform 1' is mounted between two vertical support structures 2' and 3'. The support structures 2' and 3' are fixed on a base 4'. Alternatively, two or more support structures 2', 3' can be utilized, depending on the technical and technological problems. To make the platform 1' stable between the support surfaces 2' and 3', left and right portions 5' and 6' of the platform 1', which include holes 20' and 22' through which the support structures 2' and 3' extend, are set at the same angle relative to the middle of the platform 1', and the middle part of the platform 1' is set parallel to the base 4'. The platform 1' supports an electric motor or vibrator 7' with the ends of the output shaft of the motor fixed to identical (with respect to geometric and weight parameters) unbalanced rotors 8' and 9', a power source (battery) 10', a remote control system 11', ballast weights 12 and 13', brake devices 14' and 15' and a depending hook 16'. The platform 1' is held at an arbitrary height of supporting surfaces 2' and 3' by the frictional forces at the points 19', 21' between support platform 1' at holes and 20', 22' and the support structures 2', 3'. In addition, the platform 1' is supported by the brake devices 23' and 24'. When mounting the equipment on the platform 1', he must be an even distribution of weight load over the entire surface of the platform 1'

To operate the traverse platform 1', initially an operator uses a remote control (not shown) to verifies that each actuator is mounted on the platform 1'. This can be done using a control panel (not shown) located on the remote control system 11. After confirmation, platform 1' is transferred to the operating mode. In this mode, the remote control signal is supplied to switch on the motor 7' which creates vibrations in the platform 1' initially at a frequency of 15 Hz and increased to a frequency is of 30 Hz or more, depending on the weight of the load 18'. The operator monitors the operation of mechanisms for selecting the vibration frequency for the platform 1' as it moves upwardly along up the support structures 2' and 3'.

When the desired lift height for the traverse platform 1' is reached, the operator turns off the motor/vibrator 7' and engages the braking devices 23' and 24' with the respective support structures 2', 3'. After unloading the container 17', the platform 1' can be lowered along the support structures 2', 3' by switching off the braking device 23', 24' and operating braking devices 14', 15' in conjunction with the operation of the motor/vibrator at a vibration mode of 7-15 10 Hz.

Thus, the invention discloses a vibrating platform to move cargo along the horizontal, sloping and vertical bearing surfaces and is designed for universal use for its intended purpose. Thus, the proposed arrangement of assemblies of parts in the invention combines the simplicity and efficiency, reduces the required amount of various additional parts and components simplifies the design and management of the system and provides flexibility. For the invention, in the form as it is characterized in the claims, it confirmed the possibility of using the above-described structural solutions and methods of use: the vibrating platform as the vehicle for moving cargo along horizontal, inclined and vertical surfaces, embodied in the claimed invention, in its implementation, it is able to achieve a technical result. Therefore, the claimed invention meets the condition—industrial applicability.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A transport device comprising:
- a platform including a first portion and a second portion, the second portion including a hole extending therethrough;
- a vibration generator disposed on the first portion;
- a ballast removably disposed on the first portion;
- a support structure extending through the hole in the second portion and frictionally engaged with edges of the hole; and
- a first braking mechanism disposed on the second portion and engageable with the support structure opposite the first portion, wherein the support structure does not move with the platform and ballast supported on the first portion of the platform as the platform and ballast are moved during operation of the vibration generator.

2. The device of claim claim 1 further comprising a pivot mechanism connecting the first portion and the second portion.

3. The device of claim 1 further comprising a second braking mechanism disposed on the first portion and engageable with the support structure below the platform.

4. The device of claim 1 wherein the support structure is movable between a vertical and a horizontal position.

5. The device of claim 1 further comprising a support roller disposed on the first portion.

6. The device of claim 1 wherein the platform includes a pair of second portions disposed on opposite end of the first portion and further comprising a pair of support structures extending through holes in each of the second portions.

7. A method for moving a load along a support structure, the method comprising the steps of:

providing a transport device including a platform including a first portion and a second portion, the second portion including a hole extending there through, a vibration generator disposed on the first portion, a braking mechanism disposed on the second portion and engageable with the support structure opposite the first portion and a ballast removably disposed on the first portion;

placing the support structure through the hole in the second portion to frictionally engage the support structure with edges of the hole; and operating the vibration generator to supply vibrations to the platform and to move the platform and ballast supported on the platform along the support structure, wherein the support structure does not move with the platform and ballast during operation of the vibration generator.

8. The method of claim 7 wherein the support structure is a vertical support structure.

9. The method of claim 7 wherein the support structure is an angled support structure.

10. The method of claim 7 wherein the support structure is a horizontal support structure.

* * * * *